US005931357A

United States Patent [19]

Wass

[11] Patent Number: 5,931,357

[45] Date of Patent: Aug. 3, 1999

[54] CLOSURE ARRANGEMENTS FOR CONTAINERS

[76] Inventor: Anthony Charles Lammond Wass, The Mousehole, Duddington, Stamford, lincolnshire, PE9 3QE, United Kingdom

[21] Appl. No.: 08/849,208

[22] PCT Filed: Nov. 22, 1995

[86] PCT No.: PCT/GB95/02718

§ 371 Date: Aug. 7, 1996

§ 102(e) Date: Aug. 7, 1996

[87] PCT Pub. No.: WO96/15953

PCT Pub. Date: May 30, 1996

[30] Foreign Application Priority Data

Nov. 22, 1994 [GB] United Kingdom ..... 9423585

[51] Int. Cl.[6] ..... B65D 47/20

[52] U.S. Cl. ..... 222/554; 222/556; 222/560

[58] Field of Search ..... 222/554, 556, 222/560; 220/252, 811, 815; 215/312

[56] References Cited

U.S. PATENT DOCUMENTS

| | | | |
|---|---|---|---|
| 1,430,313 | 9/1922 | Millity | 222/556 X |
| 1,960,393 | 5/1934 | Otten | 222/556 X |
| 2,127,465 | 8/1938 | Church | 222/554 X |
| 2,152,270 | 3/1939 | Nyden | 222/560 X |
| 2,185,248 | 1/1940 | Wilson | 222/552 X |
| 2,209,050 | 7/1940 | Church | 222/556 |
| 2,209,062 | 7/1940 | Lusher | 222/556 X |
| 3,410,461 | 11/1968 | Barker | 222/556 X |
| 5,156,302 | 10/1992 | Kuitems | 222/556 X |

*Primary Examiner*—Kenneth Bomberg
*Attorney, Agent, or Firm*—Hudak & Shunk Co., L.P.A.

[57] ABSTRACT

A closure arrangement for a bottle has a tiltable closure cap (14) mounted on a special neck formation having a spherical surface zone (18, 20) on the inner and/or outer surfaces. The closure cap (14) has an upper portion (36), e.g. in the form of a cap, joined to a downward extension e.g. in the form of a sealing annulus (22) which is trapped below the restricted opening formed by the neck's overhanging convergent zone (18). The annulus (22) seals in the convergent zone. The closure is opened by tilting the cap (36), e.g. with one finger, thus tilting one side of the sealing annulus (22) up and out of sealing engagement to open up a flow passage. An exterior guide part (40) of the cap (36) slides down the outer spherical surface (20) of the neck to control the tilt movement. In an alternative embodiment the sealing periphery is at the upper, cap portion of the closure which may also have a discharge spout.

23 Claims, 10 Drawing Sheets

CLOSURE ARRANGEMENTS FOR CONTAINERS

FIELD OF THE INVENTION

This invention relates to closure arrangements for containers, and especially bottles, used with flowable material.

BACKGROUND OF THE INVENTION

Most bottles are closed by screw caps, or by caps relying on frictional or snap fit. Screw caps are reliable, effective for large openings, and resistant to inadvertent opening and internal container pressure. However they are slow to use, liable to be lost, and sometimes become stuck or cross-threaded. Frictional and snap caps have low security against internal pressure and decrease in security with repeated use.

My aim is to provide new and useful container closure arrangements which may avoid some of these problems.

THE INVENTION

In one aspect I propose a closure arrangement functioning essentially as a cap which uses tilting of a peripheral seal into and out of engagement with the neck, about a tilting axis generally transverse to the neck axis, to move between closed and open conditions while remaining trapped on the neck at the neck opening; the cap makes a sliding guide engagement with a spherical surface zone of the neck wall to guide the tilt.

In a specific aspect I propose a closure arrangement for a container of flowable material, comprising a neck and a closure cap for the neck;

the neck having a neck wall defining a circular neck bore having a top opening and having a substantially spherical surface zone which is on the inside and/or outside of the neck, substantially coaxial therewith and provides an overhang of the neck wall adjacent the top opening;

the closure cap comprising an upper cap portion at the neck opening and at least one integral downward extension which engages the neck wall's spherical surface zone with a sliding guide engagement and makes a trapping engagement beneath the neck wall overhang to trap the closure cap on the neck, the cap portion and downward extension of the closure cap further providing at least one cover in the form of a closed web to block the neck bore and an annular peripheral seal for the cover;

the cover and peripheral seal of the trapped closure cap being tiltable relative to the neck, in a tilting movement guided about an axis transverse to the neck axis by at least the sliding guide engagement of the closure cap with the neck wall's spherical surface zone, between a closed condition in which the peripheral seal engages around the neck wall's circumference so that the cover blocks the neck bore and an open condition in which at least part of the peripheral seal tilts clear of the neck wall to open a flow passage around the cover.

Further more specific options are described in the sub-claims.

A coaxial spherical neck zone has the advantage of enabling e.g.

- annular sealing engagements, more effective than the angled linear joins seen in prior art constructions using tiltable nozzles and flaps;
- full guiding of tilt even without a special fulcrum engagement;

- provision of convergence and divergence for trapping;
- combination of any of these without extra complexity;
- simple manufacture.

Annular sealing around the neck wall can avoid the highly restrictive neck bore constructions required for sealing in the mentioned prior art.

A tiltable cap-type closure with a web-form cover can be easier and cheaper to make and more versatile, especially in plastics, than a ballcock-type closure.

Note that precise sphericity is not needed but the sphericity must be sufficient to provide the appropriate functions as set out herein.

The neck wall may have spherical surface zone portions on its inner and/or outer surface. Where there are both interior and exterior spherical zones they should be substantially concentric. The closure cap may have an exterior downward extension around the neck exterior and/or an interior downward extension into the neck bore. The guide engagement is made with a spherical surface zone, inside and/or outside the neck. Extra guide engagements, for example fulcrum points or axial or circumferential cams, may be used if desired. The trapping engagement requires overhang created by upward divergence on the neck exterior and/or upward convergence on the neck interior. Either of these may be provided by a corresponding spherical surface zone although this is not essential. Furthermore, while the sliding guide engagement requires an arcuate engagement track or zone having at least the angle between the open and closed conditions, a lesser angle zone may be sufficient for trapping. The cap's downward extension for trapping may be an exterior part extending down the neck exterior and inwards, e.g in the form of a skirt, sub-divided skirt or legs having downward convergence, and/or an interior part extending down and outwards, e.g. in the form of an annulus, sub-divided annulus or legs having downward divergence.

The closed condition requires a generally impermeable closure portion to span the bore and shut it, in combination with the peripheral seal. Note that 'impermeable', 'seal ' and similar terms herein may denote fluid-tightness, but the present arrangements may also be used with any flowable materials, including in some cases particulates, and the above-mentioned terms may also be construed to cover those possibilities. This closure portion or cover may be a single transverse web or layer, or constituted by plural components. It may be in the upper and/or lower portion of the closure. In one embodiment it comprises a trapped internal element in the neck bore. Additionally or alternatively it may be part of the cap portion which lies at or over the neck opening. An axial skirt may connect an annular seal to the cover web, as e.g. if the seal is trapped in the neck while the web is partly in the cap portion at the neck opening. The seal may slide over the neck surface when tilted, and this may provide part or all of the guide engagement if that is a spherical surface.

One embodiment has the cover provided as part of an external cap element, the peripheral seal being made by the cap element at or closely adjacent to the neck opening periphery; this might be however on an outer, or inner or upward surface of the periphery.

The upper portion of the closure may provide such an external cap, resting on the neck opening at its periphery in the closed position, even if the closure has a seal at an interior, lower portion. Such an exterior cap protects the closure and provides a convenient point for applying finger or hand pressure; it may have other functions as described below.

It is preferred that the neck and closure parts which provide the neck wall overhang and closure trapping also provide a guide function as referred to above. So, the neck's guide track or zone may provide an overhang and the closure's lower part, reaching under the overhang to trap the closure, also constitutes a guide follower part or complementary surface as referred to above.

The guiding engagement may include means defining one or more pre-determined stop positions, e.g. fully-open, fully-closed, partially (e.g. half) open etc. This is most convenient if the components press against one another resiliently and a localised position-defining recess on one component can receive a projection of the other. Another possibility is increasing noncomplementarity away from a limit position, tending to urge the components towards the limit position. This is an example where exact sphericity may be avoided. An 'over-centre ' relationship may be used.

Furthermore the closure and neck may make stop or limit engagements (fully-closed, fully-open) preventing tilting the parts beyond a certain angle. These may be provided by abutment surfaces of the closure, positioned relative to the tilt axis and sealing periphery so as to abut the neck at a pre-determined degree of tilt, corresponding to the desired condition of the peripheral seal, and prevent further tilting.

The upper cap portion may have a downwardly convex (curved or angled) lower surface with up-turned regions opposed across the neck to provide clearance above the neck periphery for tilting, and optionally also providing limit stop and/or seal engagements to engage the neck as suggested above. A lower region between the up-turned regions may make a fulcrum engagement with the neck.

The closure's tilting may be direct or may be combined with another movement relative to the neck. A combination of tilt with rotation of the closure around a circular neck is preferred; the closure makes an inclined cam or guide engagement around the neck so that turning around the neck drives an appropriate tilt.

The opening tilting movement may be blocked by abutment between the cap and neck until one or the other is deformed against resilience to bypass the abutment: this gives "child-resistance".

It is highly preferred that the closure be mountable onto the neck complete, by simply pushing or snapping it on. This can easily be achieved with trapping features mentioned above. The neck and/or closure may be provided with a tapering lead surface to assist forcing the lower closure portion onto and past the neck overhang. Furthermore the lower portion may be constructed with an axially asymmetric response e.g. with an upwardly-flaring portion, so that a force tending to pull the closure off the neck tends to urge the lower portion further under the overhang. For example, when the closure has an inner element with an annulus trapped in an interior zone of the neck bore, the sealing annulus may comprise a disc with conical form (which also facilitates insertion on assembly), or a sealing member positioned with axial freedom in a tapered housing groove.

Insofar as a neck of special construction is required, this may be an integral part of an appropriately-formed container, or provided as an add-on component for an existing container.

The flow opening defined past the peripheral seal in the opening condition may take any suitable form. It may simply be a space between the seal/cover web and the neck periphery. The path is preferably around or past, not encircled by, the sealing periphery. Where a portion extends down from the closure's upper portion around the outside of the neck, adequate clearance needs to be provided through or past this portion, e.g. as a hole through a cap periphery, which may take the form of a discharge spout integral with the cap.

One embodiment has a cap defining a peripheral discharge opening, e.g with a spout, whose opening in the closed condition lies at the neck's exterior, isolated from the container interior by the engagement of a sealing zone or land in the cap, above the spout, with the neck's edge. The seal is preferably a sliding seal engaging the inner and/or outer neck surface.

Upper and lower portions of the closure are preferably connected unitarily or stiffly to tilt together, and may be in one piece. However when a closure web and seal are on a trapped element whose tilt is self-guiding in the neck bore, tilting actuation may be through a flexible connection with an upper actuating portion so that a general lateral movement of the actuating portion tilts the interior sealing annulus. Furthermore, stiff unitary tilting of the cap and sliding seal does not preclude relative freedom or flexibility of other cap portions.

A connecting portion between a trapped inner element and the cap portion is preferably of a length to be in tension in the closed position.

By defining a clearance between the outer and inner elements, the connecting portion (e.g. one or more localised pillars) may provide a vent passage in the open condition provided that the lower periphery of the tilted seal clears from the neck wall when open. The connecting portion is desirably localised towards the neck axis, to provide the greatest freedom of tilt angle; a central pillar is preferred. Separate inner and outer elements may be either joined e.g. by a snap fit, or formed in one piece.

The arrangement may comprise means for avoiding inadvertent or unauthorised opening. This may comprise a tamper-evident element which fixes the closure relative to the neck, or retains another element which does, and must be broken or visibly distorted or damaged to tilt the closure. Such an element may be a ring, and may be in one piece with the closure cap, connected by one or more frangible links. A collar around the neck beneath the cap may be used, or a shroud around the closure element, preventing tilting until the shroud is removed.

Another possibility is a vent in the closure cap responsive to excess internal pressure in the closed condition to open and thereby relieve such pressure, e.g by expanding a joint between internal walls of the cap construction.

It will be appreciated that the above-described arrangements are very suitable for one-handed use, and little force is required to operate them. The closure components may be produced in plastics material e.g. by injection moulding. Polyethylene or polypropylene may be used. The special neck may be provided as part of a container, which may be a blow-moulded or injection-blow-moulded plastics bottle, or a press-and-blow moulded glass bottle.

Note that references herein to top, bottom, upper, above, below etc. are only for ease and clarity of description, and not limitative on the orientation in use.

Examples are now described with reference to the accompanying drawings, in which.

Figure 2:
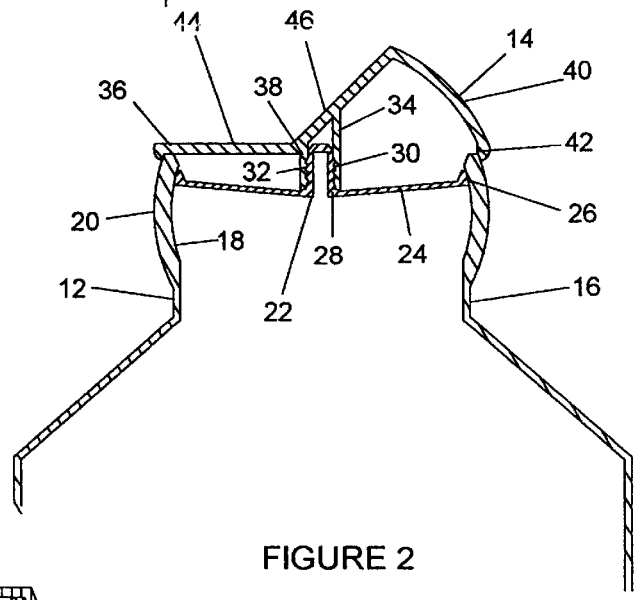
FIG. 2 is an axial cross-section of FIG. 1.
Figure 3:
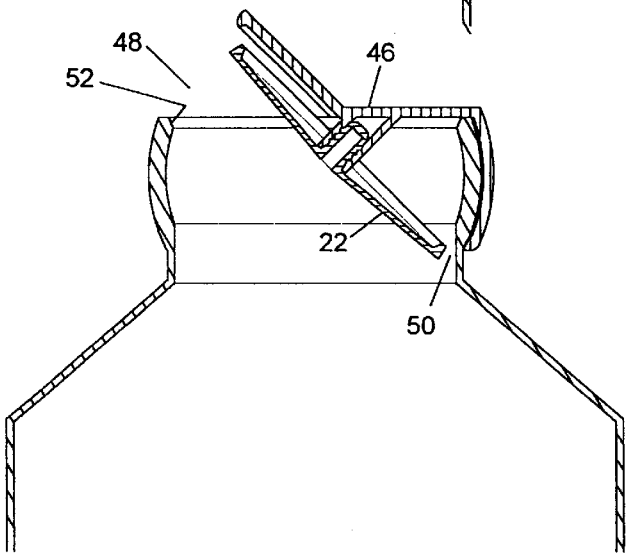
Figure 4:
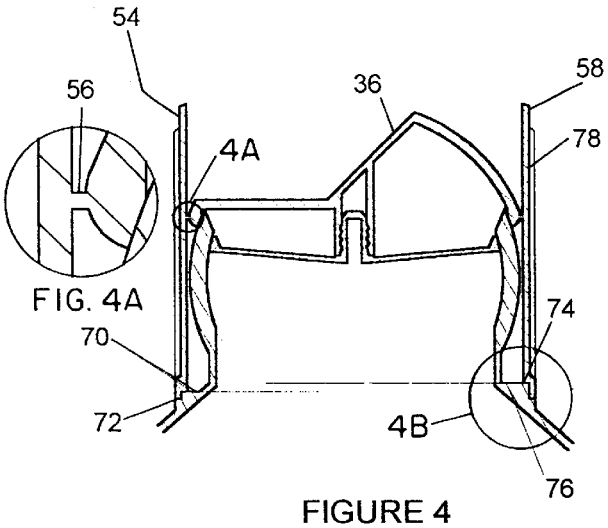
Figure 4B:
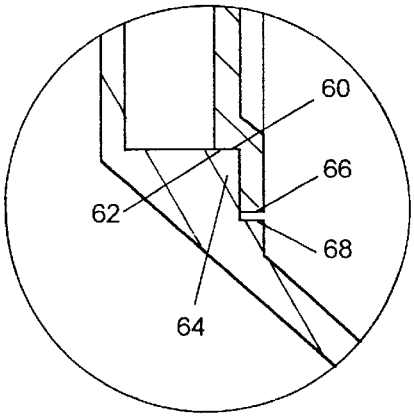
Figure 5:
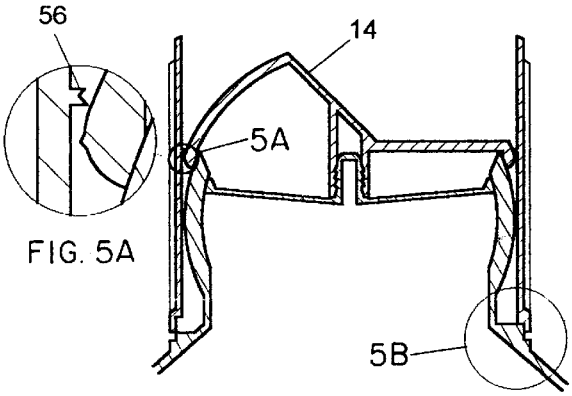
Figure 5B:
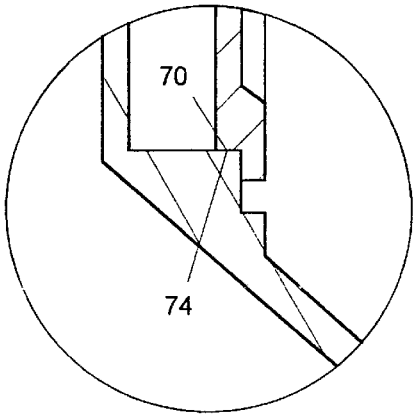
Figure 6:
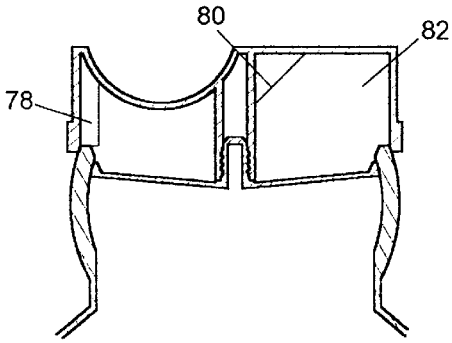
Figure 7:
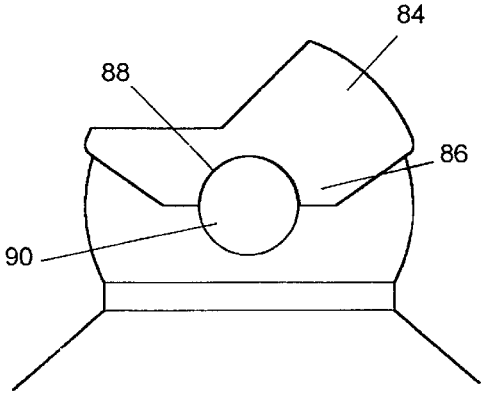
Figure 8:
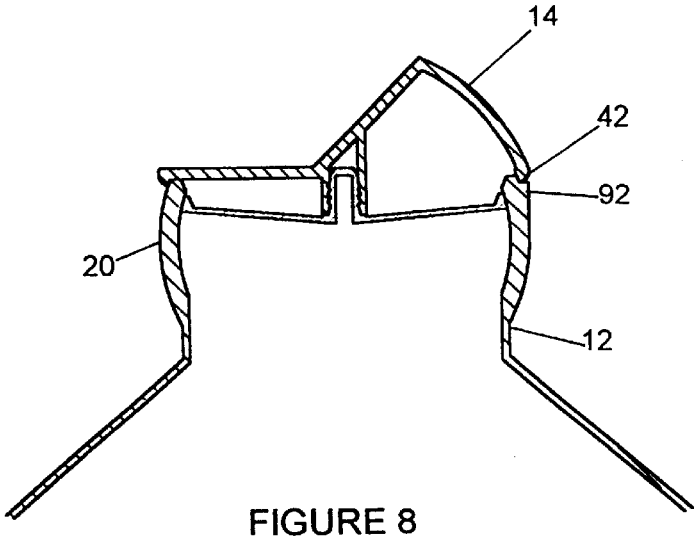
Figure 9:
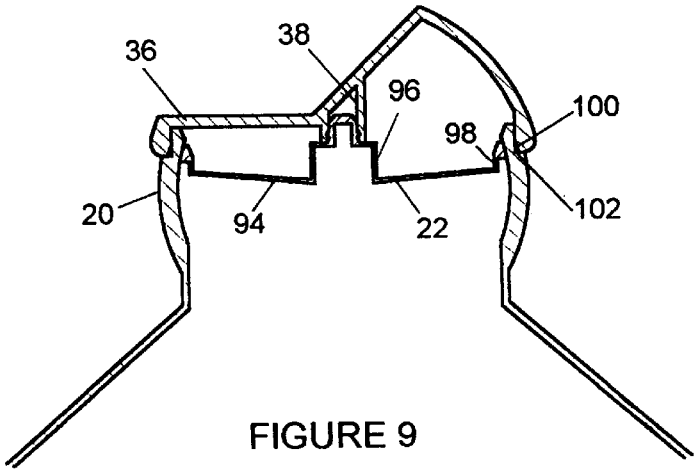
Figure 10:
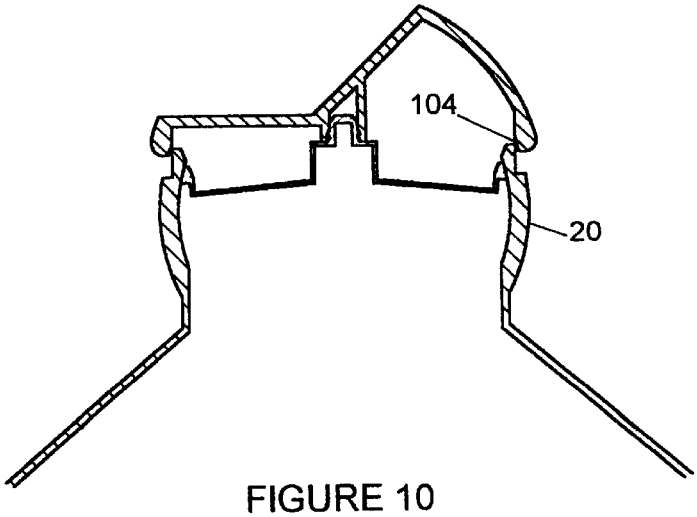
Figure 11:
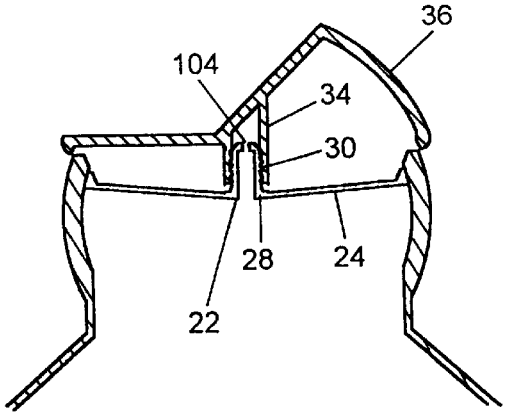
Figure 12:
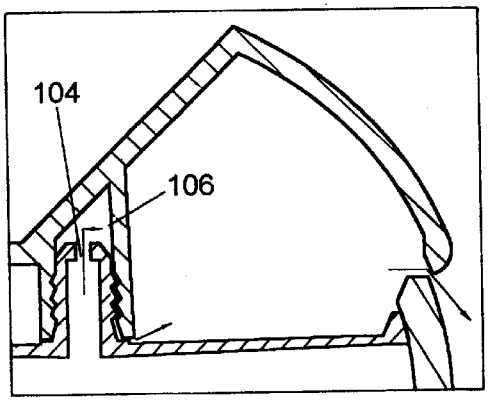
Figure 13:
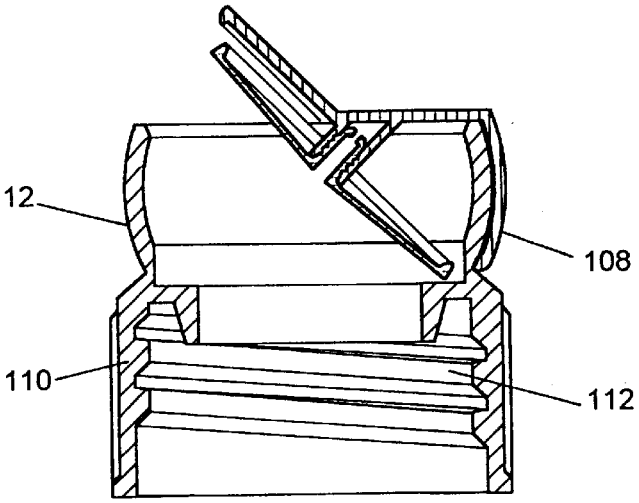
Figure 14:
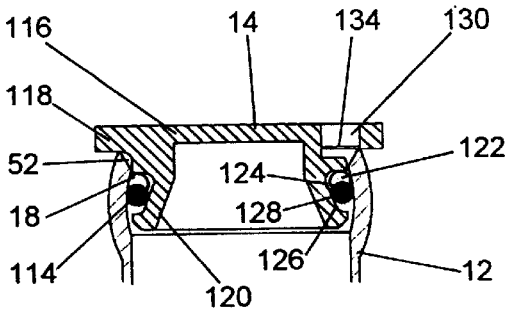
Figure 15:
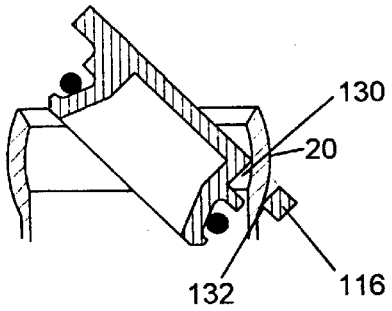
Figure 16:
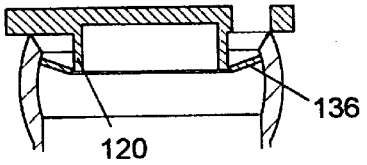
Figure 17:
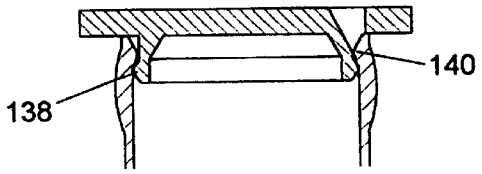
Figure 18:
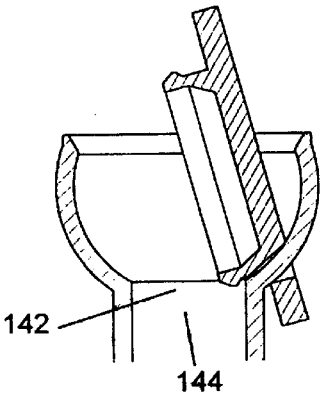
Figure 19:
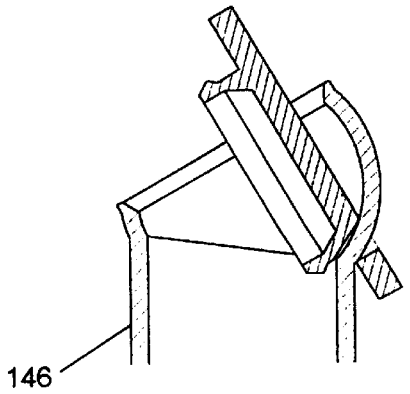
Figure 20:
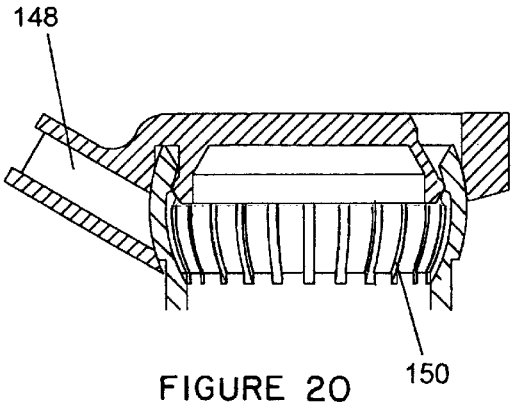
Figure 21:
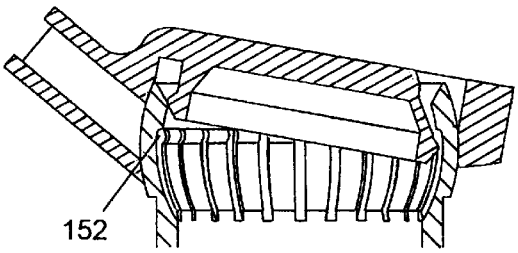
Figure 22:
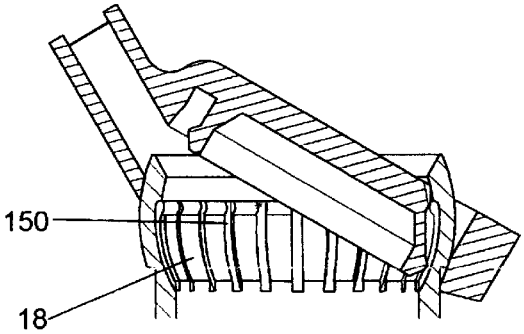
Figure 23:
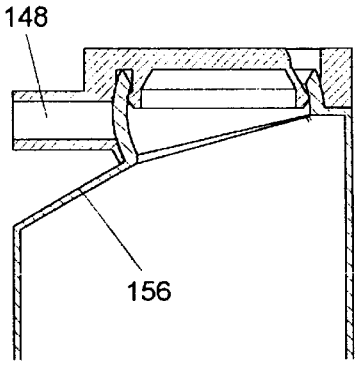
Figure 24:
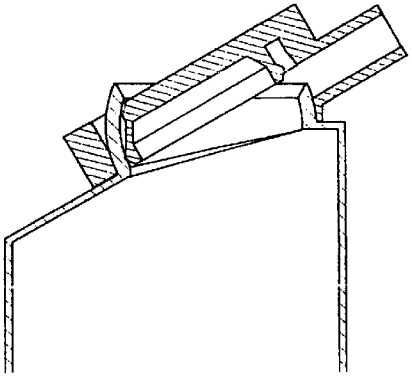
Figure 25:
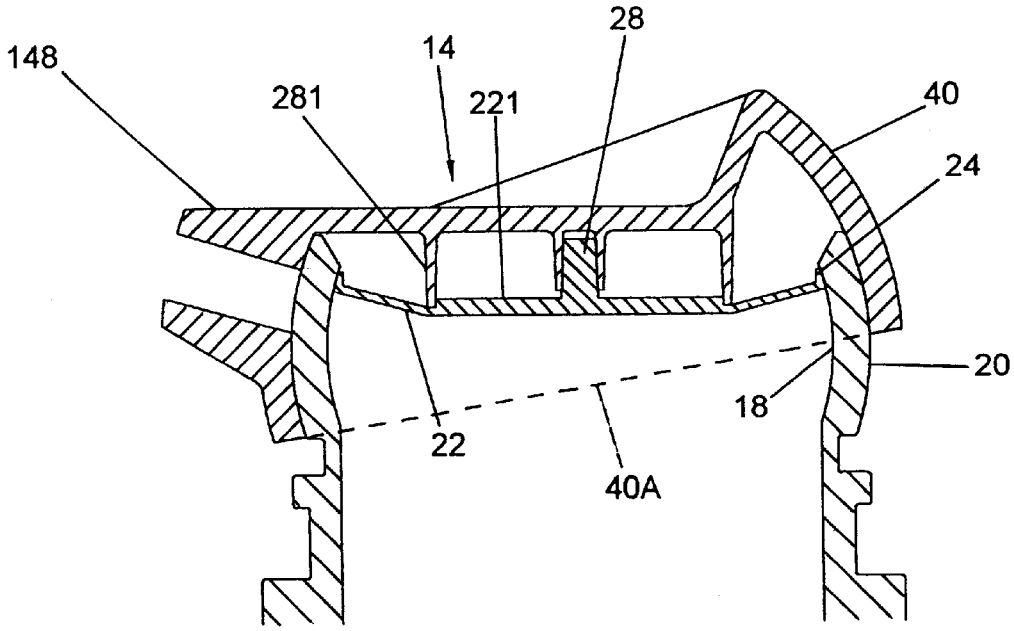
Figure 26:
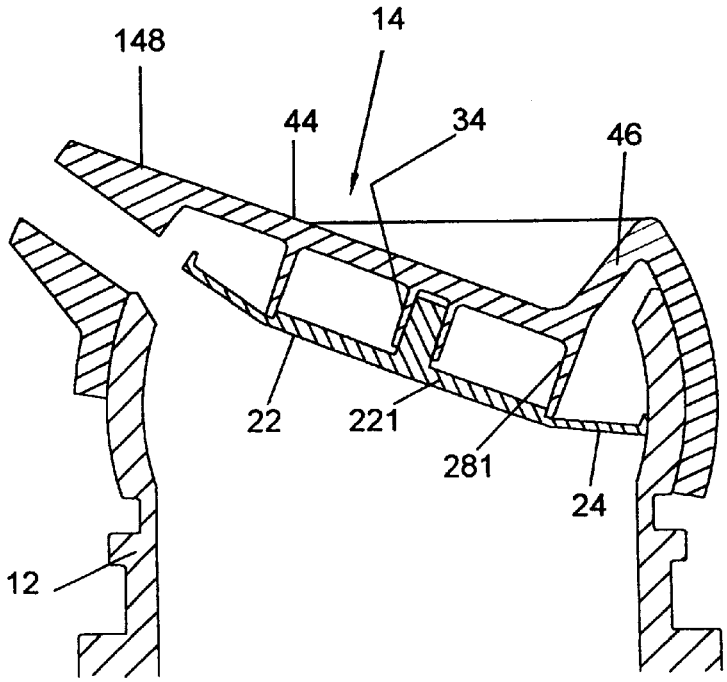
Figure 27:
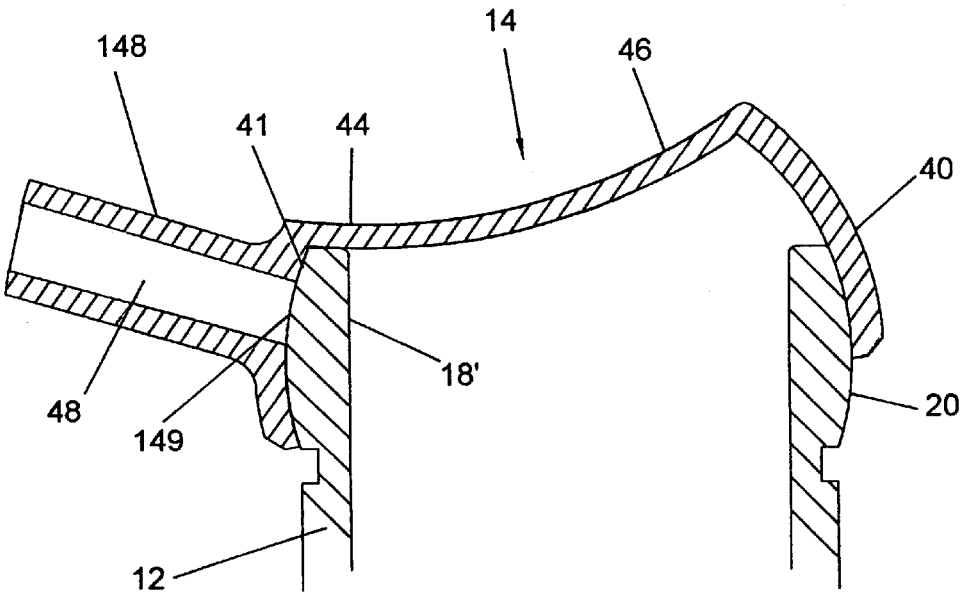
Figure 28:
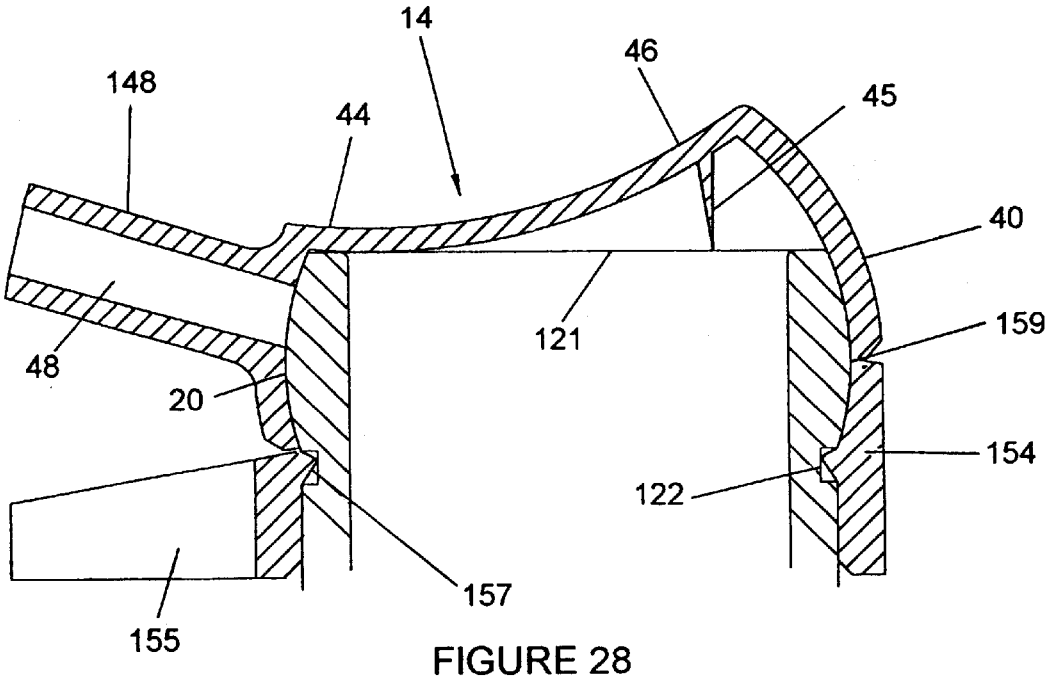
Figure 29:
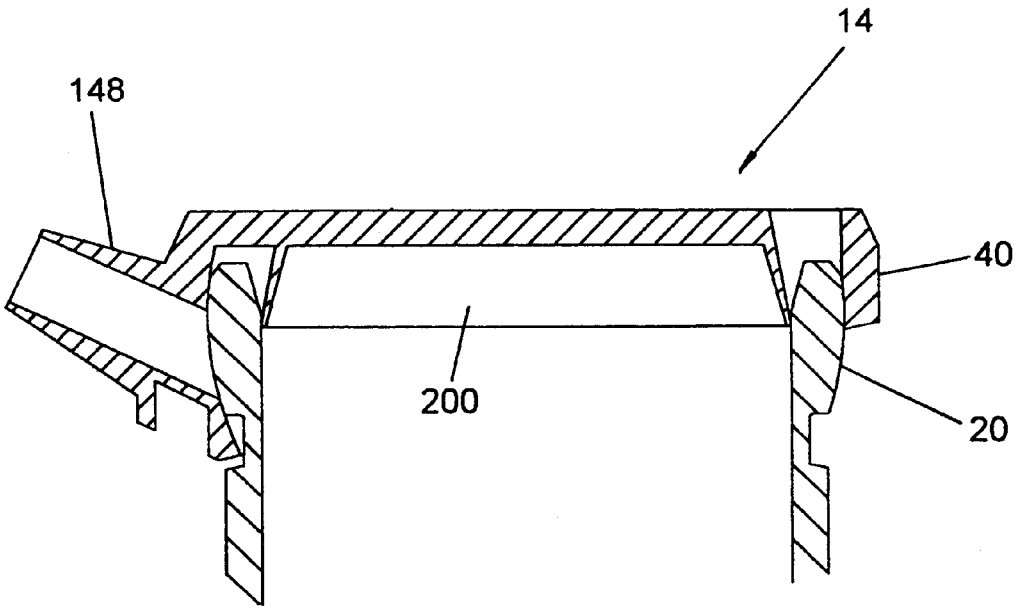
Figure 30:
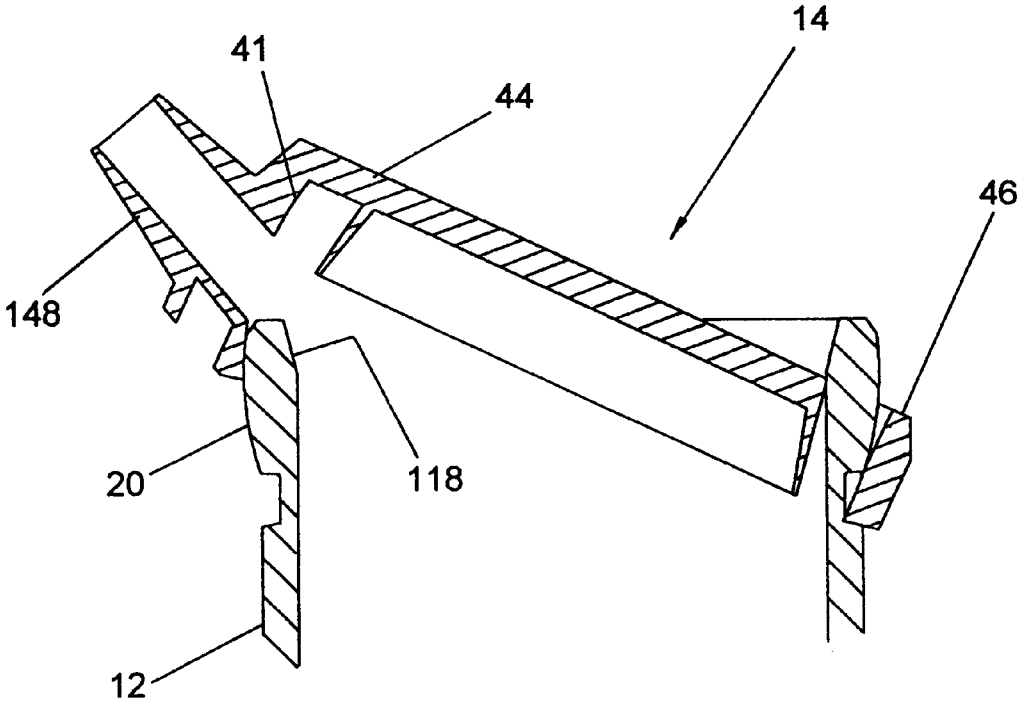
Figure 31:
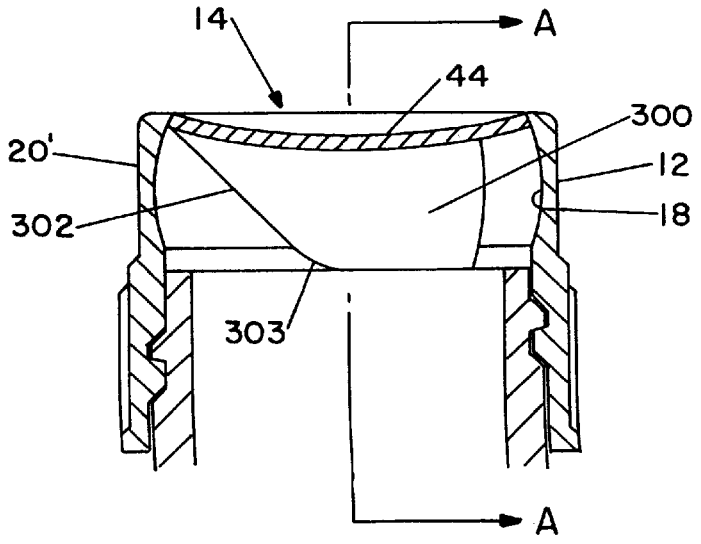
Figure 32:
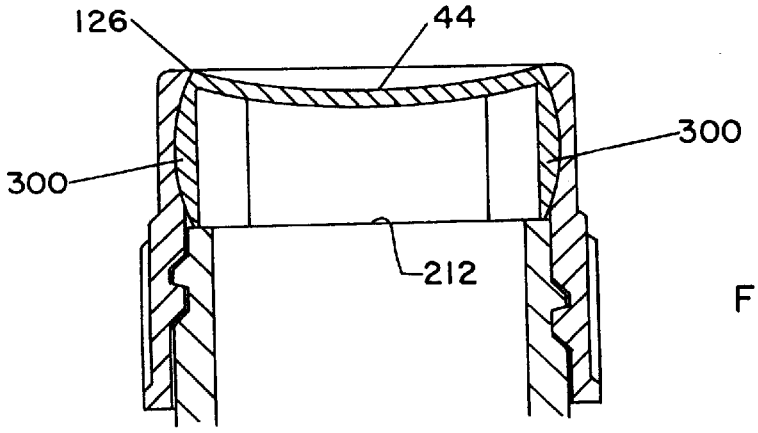
Figure 33:
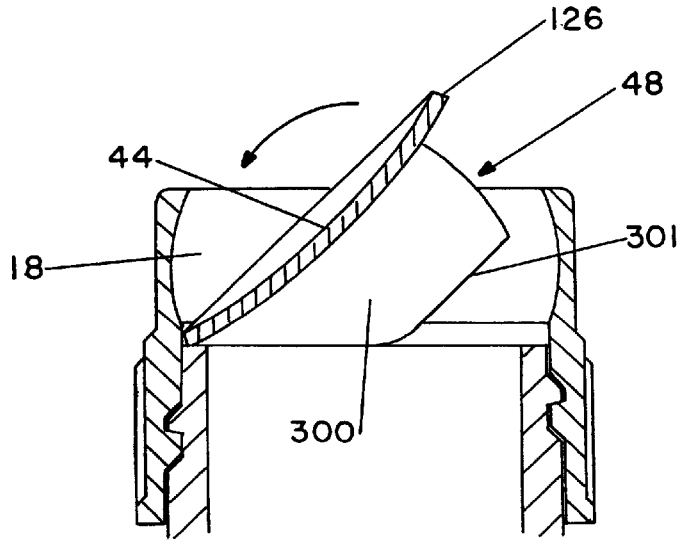

FIG. 3 corresponds to FIG. 2, but showing an open position;

FIG. 4 is an axial cross-section of the closure arrangement of a second embodiment, including a protecting shroud;

FIG. 5 shows the second embodiment after breaking the shroud connections;

FIG. 6 is an axial cross-section of a third embodiment showing alternative limit stops;

FIG. 7 is a side view showing a fourth embodiment with a unique tilting axis;

FIG. 8 is an axial cross-section of a fifth embodiment in which the cap is locked unless rotated around the neck axis;

FIGS. 9 and 10 are axial cross-sections showing a sixth embodiment, in child-resistant and operating modes respectively;

FIGS. 11 and 12 are axial cross-sections of a seventh embodiment including a pressure-relief vent;

FIG. 13 is an axial cross-section of an eighth embodiment having a screw-on adaptor;

FIGS. 14 and 15 are axial cross-sections of a ninth embodiment using an O-ring seal;

FIGS. 16 and 17 are axial cross-sections of tenth and eleventh embodiments having one-piece closures;

FIGS. 18 and 19 are axial cross-sections of twelfth and thirteenth embodiments having neck modifications to enlarge the flow passage;

FIGS. 20, 21 and 22 are axial cross-sections showing a fourteenth embodiment having a spout in closed, partially-open and open conditions;

FIGS. 23 and 24 are axial cross-sections of a fifteenth embodiment also having a spout, and using a cam action to tilt the cap between closed and open conditions;

FIGS. 25 and 26 show a sixteenth embodiment in closed and open conditions;

FIG. 27 shows a seventeenth embodiment representing a second general version in which trapping is only by an exterior cap skirt;

FIG. 28 shows an eighteenth embodiment including tamper-evident and neck sealing features;

FIGS. 29 and 30 show a nineteenth embodiment using a rigidly-mounted inner plug, and FIGS. 31 to 33 show a twentieth embodiment with the cap fitting entirely inside the neck opening: FIG. 32 is a section at A—A of FIG. 31.

Figure 1:
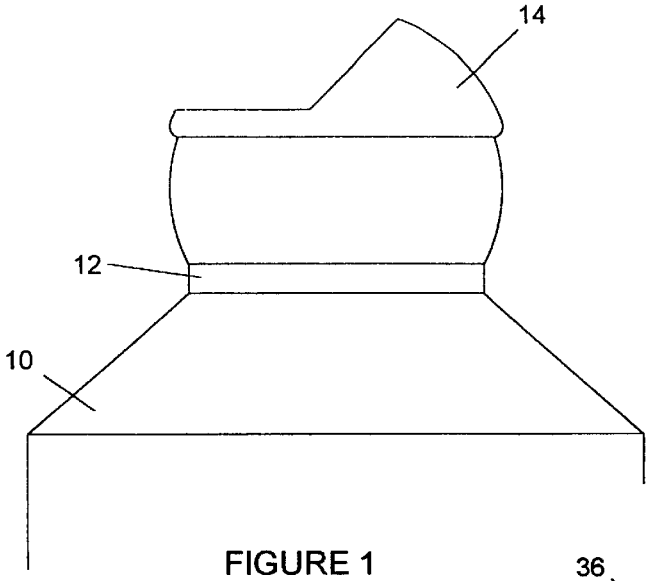
FIG. 1 is a side view of a first embodiment, showing a bottle neck and closure arrangement.

Referring to FIG. 1, a bottle 10, which in all other respects may be completely conventional, has a special neck 12 and closure 14.

Referring to FIG. 2, the bottle neck 12 has a cylindrical portion 16 joining the body of the bottle to inner and outer spherical surfaces 18 and 20. An inner sealing component 22 of closure 14 is captive within the inner spherical region and comprises a thin-walled shallow cone 24 with a thickened outer rim 26 and a cylindrical central spigot 28. External serrations 30 on this engage internal serrations 32 in the bore of a cylindrical socket 34 of outer cap component 36, forming a rigid central pillar 38 joining them together. The cap has a generally spherical form 40 with a circular rim 42 and is intersected by two flats 44,46, one parallel to the rim plane and the other inclined to that plane e.g. at about 45° . The pillar 38 keeps the rims 26,42 of the cap and sealing components in contact with the inner and outer spherical neck surfaces 18,20. The cap 14 can tilt about their common centre within the arc limited by the angle between flats 44,46. The engagements of the cap component on both the inner and outer neck surface zones cooperate to guide the tilt around the transverse spherical axis. In this closed position seals are formed internally and externally, shallow cone 24 acting as a spring to maintain a light sealing force.

To open, the cap is rotated until flat 46 contacts the neck edge (FIG. 3), opening up crescent-shaped channels 48,50 between the cover disc 22 and neck interior. In use liquid contents pour through the larger opening 48 to be replaced by air through the smaller one 50. Separation of these streams reduces the 'spluttering' that commonly occurs when pouring from bottles.

The cap is installed by resting the rim 26 of the disc 22 in the neck's conical opening 52. A downward push acts via central pillar 38 to push the shallow cone 24 through the neck opening where it immediately reexpands to hold the closure captive; force applied to pull the cap off will tend to increase the rim diameter making it even harder to remove.

A load on the top of the bottle (e.g. during storage or transportation) might open the closure. FIGS. 4 and 5 show a cylindrical sleeve 54 connected to the cap component 36 by a series of thin radial spokes 56. The top 58 of this shroud is above the cap top and a lower face 60 of the shroud rests on a stiffened ledge 62 of the bottle shoulder 64 to carry any end loads. The load surfaces 60,62 may be inclined to the shroud's outer lower end face 66, so that contact points 70,72 on the shroud and bottle respectively are lower than others 74,76 at a different rotational position. Rotation of the shroud then cams it up, breaking the spokes 56 to release it. This arrangement is tamper-proof.

The shape of the outer cap component 36 above may not be aesthetically compatible with some bottle shapes. FIG. 6 shows internal cap ribs 78,80 for the movement-limiting stops, so that the outer form 82 does not have to follow the inner so closely. This example is generally cylindrical, but there is no restriction on shape.

FIG. 7 shows an outer cap component 84 with downward extensions 86 on each side incorporating a part-circular recess 88 which bears against a mating circular feature 90 protruding from the neck form 20. The axis of these mating features passes through the common axis of the spherical surfaces so that the cap can rotate about a single tilt axis but not about the neck axis.

FIG. 8 shows a local protrusion 92 from the spherical outer neck surface 20. This prevents any tilting of the cap 14 until it has first been rotated through 180° horizontally.

In FIG. 9 the inner sealing component 22 incorporates concentric cylindrical walls 96,98 joined by a shallow conical web 94, giving spring-loaded axial movement of one cylinder relative to the other. An extended rim 100 of the cap component 36 sits in an annular recess 102 around the neck edge to prevent tilting until it has been pulled up against the spring force of the seal cone 22 to the position shown in FIG. 10, where the rim lies outside instead of within the spherical radius. Only then can it be opened. This is a child-resistant feature.

In the embodiments described so far, internal pressure is completely contained by the inner seal component 22, the main functions of the cap component 36 being to hold the inner component in contact with its seal seating when there is no appreciable internal pressure and to provide a means and co-operative guide for moving it between open and closed positions. Sealing pressure generally improves with increasing internal pressure, but if the cone 24 is completely flattened any further increase of pressure would blow the closure off the bottle. FIG. 11 shows a small hole 104 in spigot 30 which exposes the interior of the socket 34 to container pressure, but normally forms a pressure tight seal on the spigot. At near-critical pressure it expands the socket to spoil the seal (FIG. 12) and vent the pressure.

FIG. 13 shows how the special neck 12 of the assembly 108 may be on a removable adaptor 110 comprising features enabling fastening over the neck of an existing container, e.g. a thread form 112 for a screw-top container.

In FIGS. 14 and 15, the inner sealing element is an O-ring 114. The outer cap 116 has a flange 118 which locates the inner plug portion 120 in the bottle neck 12. The ring 114 is in a groove 122 around the plug whose diameter increases from the top 124 to the bottom 126; the O-ring rests in a mid-position 128. On assembly the O-ring is pushed to the top of the groove and easily compressed through the neck opening 52. Once inside it springs back into sealing contact. Any upward force on the plug initially moves the plug rather than the O-ring, expanding it to seal more firmly and resist further movement.

Here it is difficult to form a concave cap in one piece so instead a crescent slot 130 in the cap allows part of the neck edge to pass right through the flange 116, the outer edge 132 of the slot sliding over the outer neck surface 20 as a guide. Slot 130 may be bridged by a tamper-evident member 134 (see FIG. 14) which is broken the first time the cap is opened.

FIG. 16 differs in that the O-ring is replaced by a flanged seal 136 moulded integrally with the sealing plug 120. The seal is conical but could be moulded as planar or an upward cone, forced into the form shown by pressing into the neck.

Seal diameter change with applied axial load is not always necessary and the inner seal may be a simple bead 138 as shown in FIG. 17. The cap need not be removed, so the interference with the neck throat 140 can be greater than in the other closures, and not limited to low pressure applications.

Opening angles over 40 or 45° require the spherical neck portion to bulge beyond the general neck diameter (FIG. 18); large rotation of the cap tends to reduce the flow opening 142. FIG. 19 shows an asymmetrical neck arrangement 146 enabling a very large opening relative to the general neck diameter.

In FIGS. 20 to 22 the captive closure incorporates a spout 148 which can easily be moved between closed and open e.g. by moving the bottle while the spout is held. Sudden pressure release through the spout is avoided here by ribs and grooves 150 of the inner neck surface 18 which extend down from just below the sealing zone. The ribs guide but do not seal. As soon as the seal moves (FIG. 21) one or more grooves opposite the spout open to atmosphere and release pressure; the spout then opens without a sudden spurt. For full pressure release a bead 152 of the inner neck surface can provide an intermediate delay detent: a "two-click" operation. This embodiment also shows that the neck's sealing zone although generally annular need not itself be spherical in shape.

Such ease of opening may be a disadvantage e.g. in a car. The spout 148 in FIG. 23 sits on an asymmetrical neck form 154 with its lower edge in contact with sloping bottle shoulder 156. This prevents direct tilting, but rotation of the cap around the neck cams it to an open position (FIG. 24): effectively the tilt axis rotates.

FIGS. 25 and 26 show a sixteenth embodiment which also uses a discharge spout 148 integral with the cap 14. The sealing disc 22 has a strengthened central zone 221, only a minor peripheral region 24 is conical. The disc 22 is supported from above by central support at the socket 34 and also by a downward skirt 281 which fits around the central reinforced region.

A particular feature is that the spherical-form skirt 40 of the cap 14 extends down past the centre of the spherical neck forms 18,20 (broken line 40A). The skirt 40 therefore traps the cap 14 on the neck 12 as well as guiding the tilting movement.

By relying on the outer skirt 40 for trapping, trapping of a cap portion inside the neck can be obviated. Upward convergence of the neck interior (which may be difficult to make in some materials) may therefore also be obviated. Peripheral sealing may be provided by engagement of the cap or skirt interior with a peripheral region of the neck, e.g. the exterior periphery. Of course, an interior seal may also be used if desired.

FIG. 27 shows a seventeenth embodiment using these ideas. The neck interior 18' is a plain cylinder. Only the exterior has a spherical zone 20. The cap 14 has a concave top web with opposed angled limit portions 44,46 and a peripheral skirt 40, also of spherical interior form, which extends down past the neck's spherical centre to trap the cap on the neck. A discharge spout 148 is on the cap 14 adjacent the "closed" limit stop 44; its discharge passage 48 has an inner opening 149 through the spherical surface of the skirt interior, which has a sealing zone 41 extending above the opening 149. General sealing is by the face-to-face engagement of the skirt interior with the neck exterior. When open the discharge opening 149 lifts clear of the neck edge to open the flow passage 48. When closed the cap sealing zone 41 slides down onto the neck exterior 20 and isolates the passage 48 from the neck interior.

FIG. 28 shows an eighteenth embodiment in which the bottom edge of the skirt 40 is joined integrally at a frangible joint 159 to a tamper-evident collar 154, surrounding the neck and axially locked by a flange 157 engaging in a groove 122 of the neck 12. The upper edge of the collar 154 is inclined relative to the neck axis, corresponding to the closed condition tilt. Using the spout 148 and a collar flange 155 as levers, turning the spout 148 through 180° from the flange 155 shears the tamper evident link 159 and cams the spout 148 to the open position (compare FIGS. 23 and 24).

This closure also embodies a way of achieving more secure sealing. A heat-sealed membrane 121 closes off the neck opening before use. A spike 45 or other suitable rupturing member is provided on the cap's underside. The opening rotation and tilt shears the membrane 121 ready for use.

FIGS. 29 and 30 show a nineteenth embodiment in which a non-trapped inner plug 200 is formed as part of the cap 14. This seals in the bore substantially at the level of the spherical centre. Above this the neck bore has a divergent band 118 which enables tilting and increases the flow passage size. It also guides the plug 200 into the bore during both operation and assembly. The cap's seal 41 against the neck's exterior is also effective, so both exterior and interior seals are present in a single rigid construction.

FIGS. 31 to 33 show a twentieth embodiment in which no part of the closed cap contacts the neck exterior. It has a circular cover web 44—here dished to resist internal pressure—with two opposed downward ears 300 each of substantially spherical exterior contour. The neck 12—here shown as an adaptor 110 to fasten onto existing container neck 12'— has a plain exterior 20' and spherically recessed interior 18. The cover web's circular periphery 126 seals around the inner surface of the neck interior at the opening when closed. A gap 48 between the ears' upright front edges provides a flow passage when tilted. Each ear has mutually inclined stop surfaces 301,302 meeting at a rocking vertex 303: these rest on the container neck edge 212 (they could also act on internal neck formations) to define the open and shut limit positions. The ears' spherical contour traps the closure 14 in the opening and also guides the tilting, while the neck's spherical contour complements these and in this embodiment also provides a sealing zone. A feature here is that the entire arrangement may be made by a two-shot moulding process.

I claim:

1. A closure arrangement for a container of flowable material, comprising a neck and a closure cap for the neck;

the neck having a neck wall defining a circular neck bore having a top opening and having a substantially spherical surface zone which is on the inside and/or outside of the neck and substantially coaxial therewith and provides an overhang of the neck wall adjacent the top opening;

the closure cap comprising an upper cap portion at the neck opening and at least one integral downward extension which engages the neck wall's spherical surface zone with a sliding guide engagement and makes a trapping engagement beneath the neck wall overhang to trap the closure cap on the neck, the cap portion and downward extension of the closure cap further providing at least one cover in the form of a closed web to block the neck bore and an annular peripheral seal for the cover;

the cover and peripheral seal of the trapped closure cap being tiltable relative to the neck, in a tilting movement guided about an axis transverse to the neck axis by the sliding guide engagement of the closure cap with the neck wall's spherical surface zone, between a closed condition in which the peripheral seal engages around the neck wall's circumference so that the cover blocks the neck bore and an open condition in which at least part of the peripheral seal tilts clear of the neck wall to open a flow passage around the cover.

2. A closure arrangement according to claim 1 in which the spherical surface zone is present on the neck wall exterior and said or a said downward extension of the closure cap is an exterior downward extension contacting the neck wall's exterior spherical surface zone.

3. A closure arrangement according to claim 2 in which the sliding guide engagement comprises the slidable engagement of the closure cap's exterior downward extension with the neck wall's exterior spherical surface zone.

4. A closure arrangement according to claim 2 in which the neck wall's exterior spherical surface zone provides a said overhang and the trapping engagement comprises the slidable engagement of the closure cap's exterior downward extension with the neck wall's exterior spherical surface zone past the overhang.

5. A closure arrangement according to claim 2 in which the peripheral seal of the cover comprises an inwardly-directed portion of the closure cap's exterior downward extension which is slidably movable into sealing contact around the neck wall's exterior surface.

6. A closure arrangement according to claim 2 in which the closure rap's exterior downward extension comprises a downward skirt extending around the closure cap.

7. A closure arrangement according to claim 6 in which the skirt has a substantially spherical inwardly-directed form slidably complementing the neck wall's exterior spherical surface zone.

8. A closure arrangement according to claim 1 in which the spherical surface zone is present on the neck wall Interior and said or a said downward extension of the closure cap is an interior downward extension contacting the neck wall's interior spherical surface zone.

9. A closure arrangement according to claim 8 in which the sliding guide engagement comprises the slidable engagement of the closure cap's interior downward extension with the neck wall's interior spherical surface zone.

10. A closure arrangement according to claim 8 in which the neck wall's interior spherical surface zone provides a said overhang and the trapping engagement comprises the slidable engagement of the closure cap's interior downward extension with the neck wall's interior spherical surface zone past the overhang.

11. A closure arrangement according to claim 8 in which the closure cap's interior downward extension comprises an annulus inside the neck bore, contacting around the neck wall interior.

12. A closure arrangement according to claim 10 in which the closure cap's interior downward extension is adapted to increase its diameter in response to an upwardly-directed urge thereon relative to the neck.

13. A closure arrangement according to claim 8 in which the peripheral seal for the cover comprises an outwardly-directed annulus of the closure cap's interior downward extension, slidably movable into sealing contact around the neck wall's interior surface.

14. A closure arrangement according to claim 13 in which the closure cap's interior downward extension comprises an annular web inside the neck bore constituting a said cover.

15. A closure arrangement according to claim 14 in which the annular web comprises a web of downwardly-convergent conical form.

16. A closure arrangement according to claim 1 in which the upper cap portion provides a said cover which extends over the neck opening in the closed condition.

17. A closure arrangement according to claim 1 in which the upper cap portion has a circumferentially-localised peripheral discharge opening which in the closed condition lies at the neck's exterior.

18. A closure arrangement according to claim 17 in which the closure cap comprises a discharge spout at said peripheral discharge opening.

19. A closure arrangement according to claim 1 in which the closure cap and neck are adapted to make one or more stop engagements preventing tilt beyond one or more predetermined relative angular positions.

20. A closure arrangement according to claim 1 in which the closure cap is movable relative to the neck between a locked condition in which it cannot be tilted and an operational condition in which it can be tilted.

21. A closure arrangement according to claim 20 in which at least one of the cap or neck must be deformed against its resilience to adjust it from the locked to the operational condition.

22. A closure arrangement according to claim 1 comprising a tamper-evident element which prevents the tilting of the cap relative to the neck but can be broken to permit such tilting.

23. A closure arrangement according to claim 1 in which the cap comprises means for venting excess pressure from the neck interior in the closed condition through a vent separate from the peripheral seal.

* * * * *